United States Patent [19]

Ruhl

[11] Patent Number: 4,481,800

[45] Date of Patent: Nov. 13, 1984

[54] COLD ROLLING MILL FOR METAL STRIP

[75] Inventor: Robert C. Ruhl, Cleveland Heights, Ohio

[73] Assignee: Kennecott Corporation, Cleveland, Ohio

[21] Appl. No.: 435,981

[22] Filed: Oct. 22, 1982

[51] Int. Cl.[3] ..... B21B 37/00

[52] U.S. Cl. ..... 72/10; 72/21; 72/243; 72/245

[58] Field of Search ..... 72/11, 16, 17, 35, 38, 72/199, 241, 245, 10; 364/472

[56] References Cited

U.S. PATENT DOCUMENTS

| | | | |
|---|---|---|---|
| 2,003,160 | 5/1935 | Townsend et al. | 72/241 |
| 2,685,807 | 8/1954 | Hudson | 72/243 |
| 3,103,138 | 9/1963 | Wallace . | |
| 3,323,344 | 6/1967 | Mersek | 72/238 |
| 3,389,588 | 6/1968 | Reinhardt | 72/8 |
| 3,391,557 | 7/1968 | Fox | 72/16 |
| 3,499,306 | 3/1970 | Pearson | 72/17 |
| 3,550,413 | 12/1970 | Barnikel | 72/8 |
| 3,974,672 | 8/1976 | Herbst | 72/35 |
| 4,149,395 | 4/1979 | Fapiano | 72/11 |
| 4,218,907 | 8/1980 | Ruhl | 72/241 |
| 4,365,496 | 12/1982 | Shiozaki et al. | 72/17 |

OTHER PUBLICATIONS

Javorik et al, "Electrohydraulic System Controls Cold Strip Rolling Mill", *Hydraulics & Pneumatics,* Jul. '78, pp. 59–61.

Kitao et al, "Advanced Gage Control System in Cold Tandem Mills", *Hitachi Review,* vol. 28, Oct. 1979, pp. 245–249.

*Primary Examiner*—E. Michael Combs
*Assistant Examiner*—Charles Rosenberg
*Attorney, Agent, or Firm*—R. Lawrence Sahr

[57] ABSTRACT

A rolling mill system for the continuous rolling of metal strip or strand into a strip of predetermined thickness and straightness is disclosed. The system includes a frame in which two metal working rolls are mounted in such a way that both the distance or nip between the rolls and the tilt of one roll with respect to the other may be regulated by two gap adjusting devices mounted in the roll frame on opposite sides of the centerline of the metal strip. At least one of the gap adjusting devices is operated responsive to a signal representing a measurement of the straightness of the strip product. The gap adjusting devices are hydraulic assemblies wherein each piston is affixed to a piston rod and each piston rod is affixed at its opposite end to a chock block in which the movable roll is carried. A position indicating rod which constitutes part of a position transducer is affixed to the opposite face of each piston to allow for monitoring of the actual distance between the two rolls at each end thereof. The motor drive from one roll is mounted on a door forming part of the roll mill frame to allow for free access to the rolls and chocks. The straightness or camber of the strip product is monitored and the tilt of the movable roll with respect to the other roll is controlled responsive to signals representative of variations in camber.

20 Claims, 6 Drawing Figures

COLD ROLLING MILL FOR METAL STRIP

BACKGROUND OF THE INVENTION

1. Field of the Invention

This invention relates in general to the cold rolling of metal strip. More specifically, it relates to a system for controlling the thickness and camber (straightness) of the strip product. In another aspect, the invention provides a roll stand frame wherein one roll drive motor is mounted on a pivoting door to allow for access to the rolls and interior of the roll frame.

2. The Prior Art

The prior art uses the term "camber" to defime the amount of edge curvature of a strip width of rolled sheet metal with reference to a straight edge. The prior art discloses a number of devices for effecting control of the strip "camber". Typically, these prior art systems change the shape of one of the metal working rolls, by changing the temperature profile of that roll, responsive to signals received from a sensing element which monitors the strip product. U.S. Pat. No. 4,262,511 issued to Boisvert et al, for example, discloses a "shapemeter" in the form of a segmented rotor supported by an air cushion and in contact with the sheet metal product. Pneumatic signals from the segmented rotor are converted into electrical signals which, in turn, control the distribution of coolant onto the metal roll surfaces. The teachings of U.S. Pat. No. 3,499,306 issued to Pearson are somewhat similar.

Control of the gauge or thickness of rolled sheet metal has been of major concern in the art since the inception of metal rolling and the approaches to such control have been quite varied. Typically, provision is made for measurement of the force tending to separate the metal working rolls and for regulation of that force by adjustment of the position of one roll with respect to the other. See, for example, U.S. Pat. No. 3,550,413 issued to Barnikel. However, where the thickness of the feed stock varies, regulation of the roll separating force alone is insufficient to produce a product of constant thickness or gauge. With this latter problem in mind Fox, in U.S. Pat. No. 3,391,557 proposed to monitor the thickness of the metal feedstock and to vary the loading on the millstand roll journals in accordance with variations in the thickness of the feed stock. Additionally, numerous other approaches have been attempted. For example, Reinhardt et al U.S. Pat. No. 3,389,588 discloses an electrical system for measuring the actual roll gap and for operating a hydraulic system for raising or lowering the bottom work roll to maintain the desired roll gap. Wallace U.S. Pat, No. 3,103,138 measures the actual thickness of the strip product by an x-ray device and varies the hydraulic pressure exerted on the upper working roll responsive to a signal generated by the X-ray device.

An ancillary problem in the metal rolling industry is the removal and replacement of the cylindrical rolls and bearings. Mersek in U.S. Pat. No. 3,323,344 discloses an arrangement wherein the outboard bearing housing for the metal rolls is constructed and arranged for pivotal movement to a position permitting changing of the roll dies.

It is an object of the present invention to provide a metal rolling mill, especially a cold rolling mill, which provides a rolled product of uniform thickness (gauge) and straightness (camber), even with a feedstock strip of somewhat variable thickness.

It is another object of the present invention to provide a control system whereby gauge and camber may be regulated with insignificant lag time between detection and correction.

Another object of the present invention is to provide a control system for tandem control of such roll millstands to regulate the strip tension between the roll millstands.

Yet another object of the present invention is to provide a simple, relatively maintenance-free device for measurement of changes in the actual roll gap.

Still another object of the present invention is to provide a roll millstand in which adjustments to the cross-sectional profile of the strip may be made simply by adjusting the tilt of one metal working roll with respect to the other, and without any change in the shape of the rolls per se.

A still further object of the invention is provision of a frame for the roll millstand permitting access for changing the cylindrical rolls.

A further object is to create a very compact and moderate-cost millstand with relatively high torque and horsepower per unit width.

Other objects and further scope of applicability of the present invention will become apparent from a reading of the detailed description to follow, taken in conjunction with the accompanying drawings.

SUMMARY OF THE INVENTION

The present invention provides a rolling mill system whereby the camber of the strip product can be regulated by adjusting the tilt of one metal working roll with respect to the other. Thus, in the present invention, camber of the strip product can be regulated without changing the profile of the surface of the metal working roll. An individual roll stand of the present invention includes a pair of metal working rolls mounted in a frame with one of the working rolls being movable with respect to the other and with respect to the frame. At least two gap adjusting devices are mounted on the frame, on opposite sides of the centerline of the metal strip, to allow forces to be applied independently to opposite ends of the movable metal working roll. Control circuitry in cooperation with a camber-monitoring device generates a command signal for operating at least one of the gap adjusting devices in a manner which changes the tilt of the movable working roll, with respect to the other roll. Preferably, each roll is mounted in radial bearing segments contained in a unitary chock block to minimize roll deflection.

Provision is also made for monitoring the changes in distance between the two metal working rolls, at each end thereof, by position transducers associated with the gap adjusting devices. Toward this end, each gap adjusting device preferably consists of two hydraulic assemblies, mounted adjacent opposite ends of the movable metal working roll. Each hydraulic assembly includes a cylinder, a piston mounted therein and a piston rod affixed at one end to the piston and at the other end to the chock block which carries the movable metal working roll. At the cap end of each piston is affixed a rod which is axially aligned with the cylinder and piston rod and which carries a transducer component which moves within the bore of a second fixed transducer component to generate a position signal proportional to the distance through which the rod carried transducer component moves relative to the fixed transducer component.

Each detector rod is connected directly to the piston of the gap-adjusting hydraulic assembly. By "directly" is meant that no hydraulic or other mechanical device is interposed between the (1) the connection between the detection rod and the piston of the gap-adjusting hydraulic assembly and (2) the transducer element carried by the detection rod, rather, a rigid connection is provided between the piston and the transducer element.

The present invention also provides a roll mill frame enabling easy access for removal and replacement of the cylindrical rolls and their bearings. The frame of the present invention includes a base and three fixed sides with a door, mounted for pivotal movement about a vertical axis, forming the fourth side. The motor drives for the rolls are mounted on the exterior of the door so that they may be moved out of the way when the rolls or roll bearings are to be changed.

The present invention also provides control circuitry for automatic camber control (ACC) responsive to a signal representing the difference between the pressures exerted on the load cells. A voltage signal representative of that pressure difference is converted to a value for actual camber which, in turn, is converted to a control signal for repositioning of the gap adjusting devices to provide zero camber.

The present invention further provides a control circuit for automatic control of the displacement of the hydraulic roll drive motors (ADC). The ADC circuit provides a displacement command signal to each hydraulic drive motor responsive to the speed signal received from a tachometer associated with that motor and a torque signal received from a pair of pressure transducers also associated with that drive motor.

Automatic tension control (ATC) is provided for use of two or more roll mill stands in tandem. The speed of one roll mill stand is adjusted relative to the other responsive to a signal proportional to the total loading on the load cells of the tensiometer.

Gauge control is provided for by either (1) control circuitry which regulates the gap adjusting devices responsive to a signal received from a thickness gauge which monitors the thickness of the strip product (AGC) or (2) automatic force control (AFC) whereby the hydraulic pressures at the cap end side of the piston and at the piston rod side of each gap adjusting device are measured and the difference is converted into a force signal which is compared with a preset value to determine a value for error. The AFC generates a command signal proportional to any detected error which command signal serves to reposition the gap adjusting devices.

Automatic wedge control (AWC) is used on the first stand of a tandem mill and utilizes the difference between two thickness gages to control mill tilt and achieve uniform thickness across the width of the strip (zero wedge).

DESCRIPTION OF THE PREFERRED EMBODIMENTS

The preferred embodiments will most frequently utilize two identical or similar rolling mills in tandem, with high strip tension between the stands. Less frequently, more than two stands in tandem will be desirable, for example, if very large total reductions are needed or if the incoming strip quality is poor or if the desired product tolerances are very tight. For some purposes (for example, if small total reductions are desired and/or if incoming strip quality is good and/or if the desired product tolerances are not difficult), a single stand may suffice.

Figures 1, 2:
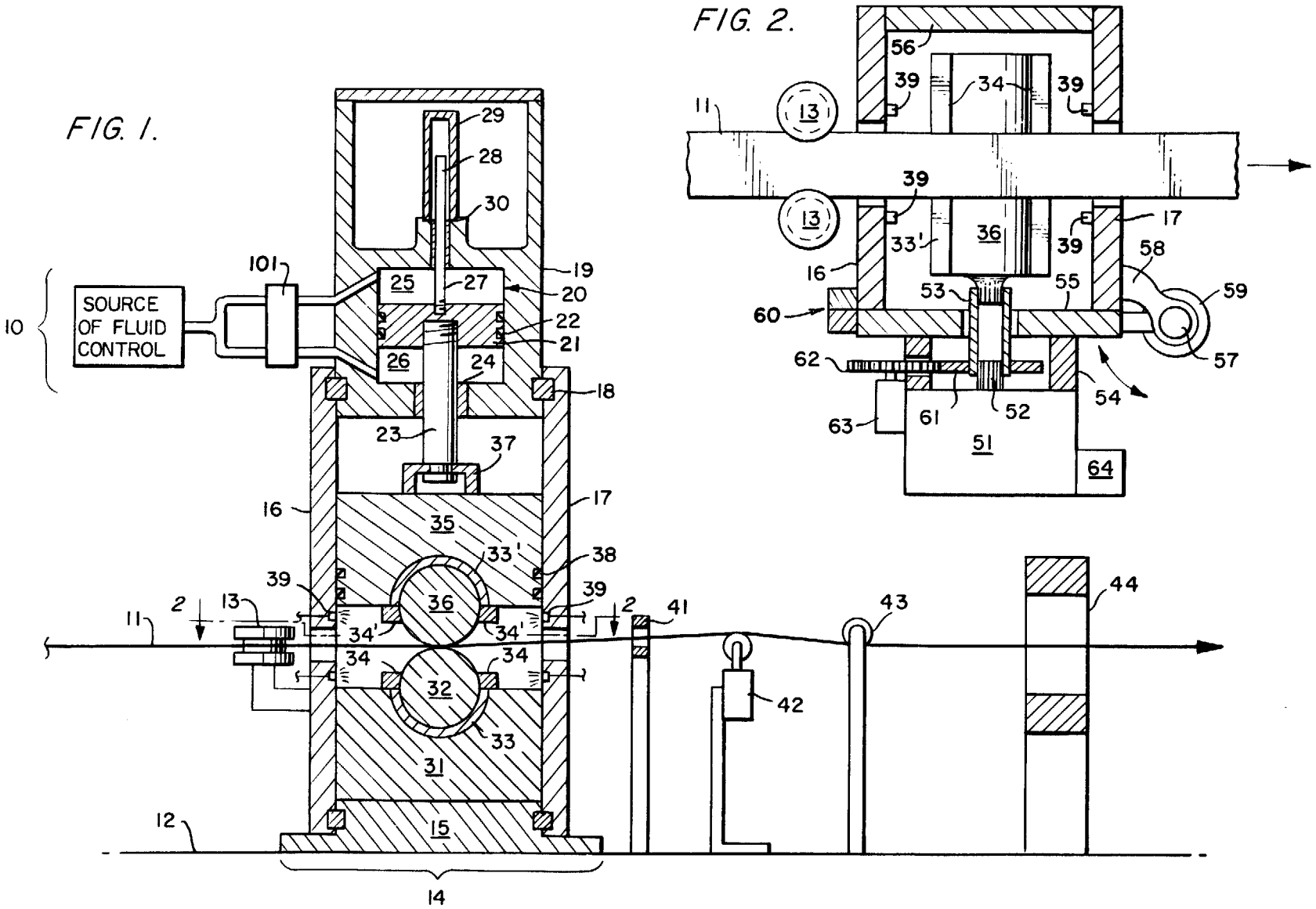
FIG. 1 is a view in perspective of a facility, in accordance with the present invention, for the continuous cold-rolling of metal strip, with the several apparatus elements shown in cross-section.
FIG. 2 is a top plan view of the of the roll stand shown in FIG. 1.

As is shown in FIG. 1, downstream from the mill stand 14 are a blow-off device 41, which blows residual rolling emulsion off the strip with compressed air exiting holes drilled in two pipes, a tensiometer 42, described in detail below, which measures strip tension and straightness, a pass-line roll 43, which defines a specific strip wrap angle over the tensiometer, and a thickness gage 44, which may be of the radiation, contact or other type, and whose use is explained below. (When wedge is to be measured in addition to thickness, two thickness gages are used on either side of the centerline.) Additional mill stands, if used, may be located immediately after the thickness gauge 44 and may use the same base 12. As the camber-monitoring tensiometer 42, the preferred device is that disclosed in commonly owned copending application entitled "CAMBER-MONITORING TENSIOMETER" (Ser. No. 435,935 filed Oct. 22, 1982 now U.S. Pat. No. 4,470,297, filed on even date), the teachings of which are incorporated herein by reference.

At the outset, a single roll mill stand and its controls will be described in detail.

THE ROLLING MILL

Referring to FIG. 1, the metal strip 11 passes between a pair of grooved entry guide rolls 13, which center the strip entering the mill stand which is designated, in general, by the numeral 14. The mill stand 14 is securely bolted to a steady base 12, which preferably also serves as the rolling emulsion reservoir.

The frame of mill stand 14 includes a base block 15, an entry plate 16, and exit plate 17 and a top block 19. The plates 16 and 17 are keyed to the blocks 15 and 19 by hardened steel keys 18 and are also secured to the blocks by screws. The frame of mill stand 14 holds the mill stand together and is designed to withstand the large forces applied in cold rolling. The frame is of relatively light construction compared to traditional rolling mills, since it is designed for strength and need not provide a high stiffness (which is achieved by the control system). The entry and exit plates 16 and 17 are designed to withstand 4000–5000 psi tensile stress near their strip openings and somewhat greater values of shear stress at the positions of the keys 18.

Within the mill frame or housing are two chock assemblies, lower chock 31 and upper chock 35. the lower chock 31 is referred to herein as the fixed chock since it does not move vertically during rolling. The lower chock 31 contains the fixed work roll 32, which is made of tool steel, cemented tungsten carbide, or similar material, and which is ground to a roundness tolerance of about 0.000025 inches and a diameter uniformity tolerance of about 0.0002 inches. The roll is contained in radial bearing segments 33, made of carbon and clamped by clamps 34, which preload the carbon segments in compression and keep the roll from rising when strip is not being rolled.

The upper chock 35 is called the movable chock since it may be raised and lowered in order to facilitate threading of the mill stand, to start and stop rolling, and to control the thickness and straightness of the strip as explained below. The movable roll 36 is identical to the fixed roll 32 and the bearing segments 33' are identical to bearing segments 33. The bearing clamps 34' also serve to hold the movable roll in place if strip is not being rolled. The bearings and chock blocks are further described in U.S. Pat. No. 4,218,907, the teachings of which are incorporated herein by reference.

Movable chock brackets 37 are used when the top chock 35 is being opened or held open to attach the chock to a pair of piston rods 23, one of which is shown in FIG. 1. During rolling, however, there is a few thousandths of an inch clearance between items 23 and 37 and the end of the rods 23 press directly on the chock 35. The lower end of each rod 23 is rounded to a large radius to allow a slight tilting of the movable chock without concentrating the contact pressure. Near the lower end of each rod 23 is a groove for receiving the brackets 37.

Both chocks may be readily slid out of the housing by first opening the door 55, as shown in FIG. 2 and as described below. Also, the rolls may be removed with the chocks remaining in the mill by removing the end plates (not shown) from the chocks. The movable chock 35 is equipped with carbon buttons 38 which lubricate its up and down motion against the smooth interior surfaces of entry and exit plates 16 and 17. The entry and exit plates 16 and 17 are drilled for fluid passages (not shown) which supply spray nozzles 39, on either side of and above and below the strip. These nozzles 39 spray a water-based oil emulsion onto the rolls, strip and bearings and act to lubricate both the bearings and the metal rolling. The emulsion then drains down into the reservoir within the base 12.

Roll Gap Adjustment

Gauge, camber, and wedge control is provided for by a pair of hydraulic assemblies 10, one of which is shown in FIG. 1. These hydraulic assemblies 10 operate to exert a regulated force, through piston rods 23, directly onto the upper chock 35. Accordingly, each hydraulic assembly 10 includes a cylindrical cavity 20, a piston 21 and a piston rod 23. The two cylindrical cavities 20 are formed as bores in the top block 19 and are symmetrically spaced on either side of the strip centerline. These hydraulic assemblies 10 are referred to herein as the fixed and movable hydraulic assemblies, respectively, for reasons that will become apparent from the further description which follows. The piston 21 is sealed to the honed bore of cavity 20 with seals 22. The large piston rod 23 is attached to one face of the piston 21 and transmits the forces from the hydraulic assembly 10 to the upper chock 35. A rod seal gland assembly 24 seals the high-pressure oil around the rod. The cap end cavity 25 and the rod end cavity 26 portions of cylindrical cavity 20 are supplied with pressurized oil responsive to signals received from a control circuit, as explained later, to create forces and to cause motion of the piston 21.

Roll Gap Measurement

A small position detection rod 27 (transducer rod) is fixed to the upper face of piston 21 in each of the two hydraulic assemblies 10. Each position detection rod 27 is axially aligned with the cylinder 20 and the piston rod 23 of the hydraulic assembly 10 and carries a magnetic core 28, located within the transformer coil 29 of an LVDT position transducer of a type designed for high internal oil pressure and which is sealed by seal 30 to the top block 19. This position transducer has a resolution of about 0.000002 inches and very good linearity and reproducibility (it is a high-quality, commercially available item) and serves to measure the position of the piston 21 relative to the fixed transformer coil 29. With this arrangement the change of the distance of displacement between coil and rod is exactly equal to the change of displacement between the two metal working rolls.

MOTOR DRIVE AND MOUNTING

Referring now to FIG. 2, a hydraulic motor 51 is provided to drive the movable roll 36. The motor 51 is preferably of an adjustable-displacement type, so that its torque and speed range may be tailored to the product being rolled. Both manually-adjustable and electrically-adjustable motors have been successfully used. An example of a suitable hydraulic motor is an axial piston motor with an electrically-adjustable displacement having a 3½ to 1 range. The motor shaft 52 mates with coupling 53, which in turn mates with the square neck of roll 36. The motor 51 is mounted with a motor mount 54 bolted to a door 55.

The door 55 pivots about a vertical shaft 57 which is supported by brackets 58 mounted on plate 17 of the roll-supporting frame. The door is mounted on linear ball bushings 59 which, in turn, are mounted on shaft 57 and which are spaced with respect to brackets 58 to allow for sliding movement vertically along the shaft 57. Thus, the linear ball bushings 59 permit the two motions needed: (1) opening and closing the door through a 90° arc to permit removing and inserting chocks and rolls and (2) raising and lowering to follow the opening and closing of the rolls. The door 55 is closed with a latch 60 which permits the up and down motions. Flexible high pressure hoses convey hydraulc fluid to and from the movable motor assembly 51 to permit these motions.

Mounted on the coupling 53 is a precision gear 61 which mates to an anti-backlash type gear 62 which, in turn, drives a DC tachometer (or an encoder-type tachometer with a DC converter) 63, thus producing an output voltage proportional to the speed of the motor (and also giving direction by polarity + or −). A proportional solenoid 64 varies the displacement of the motor as mentioned above.

On the fixed side of the mill, a fixed plate 56 is used instead of a door. An identical motor (not shown) is used to drive the fixed (lower) roll (not shown) and also has the identical tachometer 63 and displacement solenoid 64, and mechanical accessories equivalent to those provided for the movable motor.

TENSION AND CAMBER CONTROL

Figure 3:
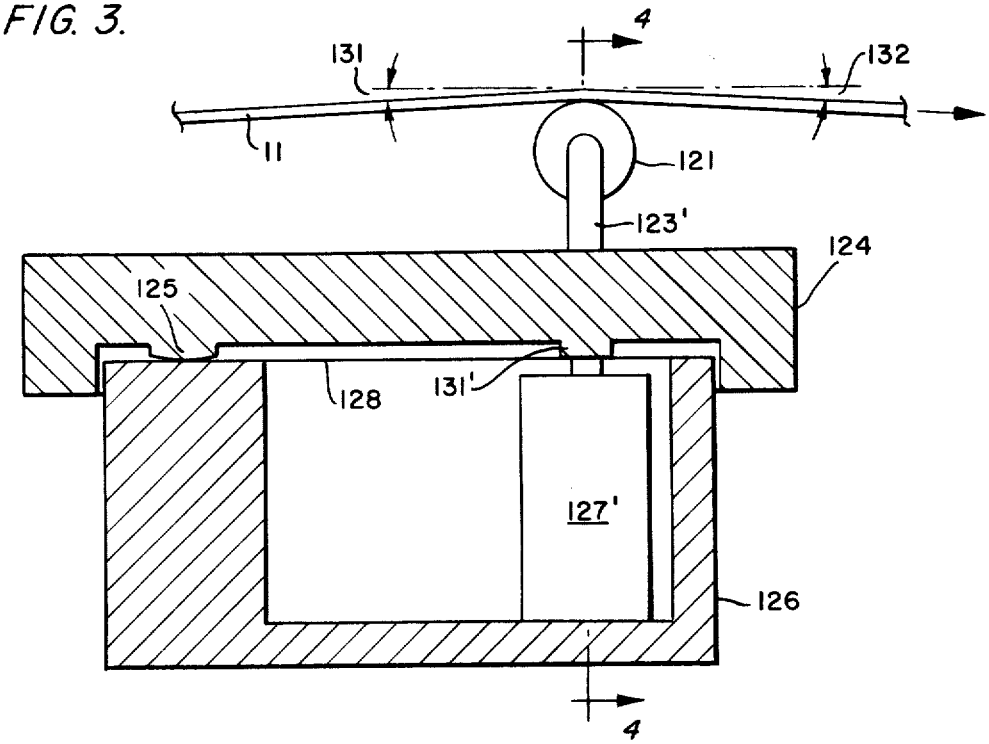
FIG. 3 is a side elevational view, in cross-section, of the tensiometer preferred for use in connection with the present invention.
Figure 4:
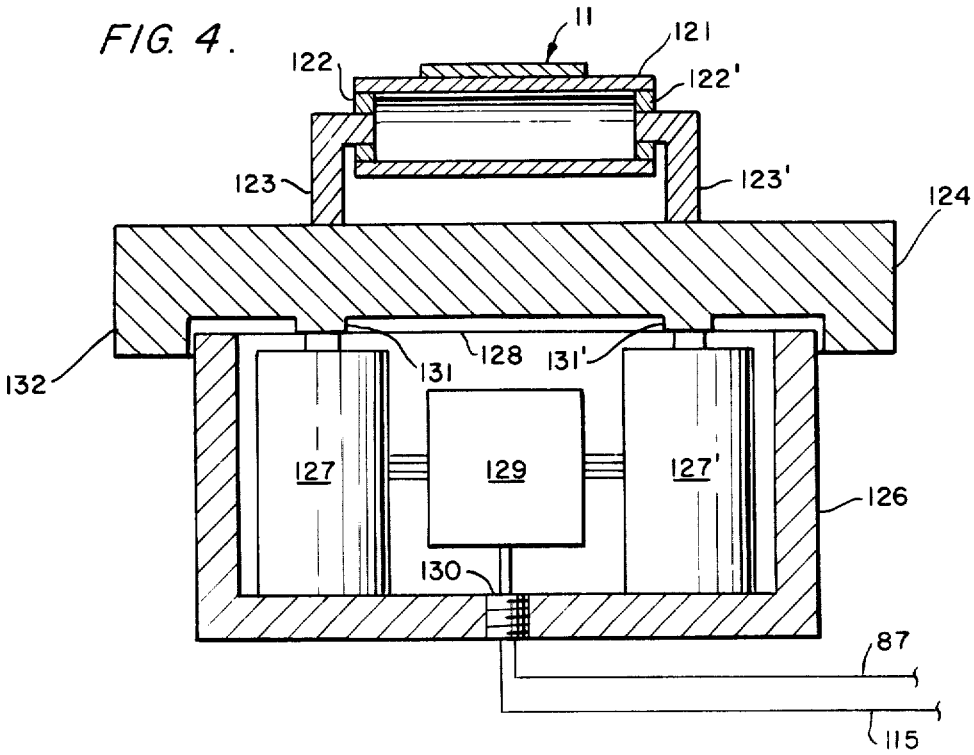
FIG. 4 is a front elevational view, in cross-section, corresponding to FIG. 3 and taken along line 4—4 of FIG. 3.

Referring to FIGS. 3 and 4, which give two sectional elevations of the tensiometer 42 of the aforementioned, copending application, the strip 11 wraps around the sensing roll 121 with a well-defined wrap angle. The sensing roll 121 is mounted on a movable top plate 124 by two posts 123 and 123', which support precision high-speed bearings 122, 122', allowing the roll 121 to turn with very little friction. The top plate 124 pivots about a pivot button 125 located on the strip centerline. Two additional projections 131 and 131' on the underside of the top plate 124 bear on two high-precision load cells 127 and 127' of the strain-gage type, thus providing a 3-point support for the top plate 124. The top plate 124 is provided with a peripheral flange 132 which overlaps the housing box 126, thus keeping the top plate 124 in place. A very thin membrane seal 128 of brass shim stock is cemented to the top of the housing 126 to form a watertight seal through which the loads may be transferred without significant errors and which covers and protects load cells 127 and 127'. The load cells 127 and 127' are equally spaced on each side of the strip centerline and are wired to a precision amplifier 129 (which may optionally be located remotely from the tensiometer). The amplifier 129 provides two output signals through a watertight connector 130, which also brings in DC power (not shown) to the amplifier. One output signal 87 is proportional to the sum of the loads on the load cells 127 and 127', while the other output signal 115 is proportional to the difference in the load cell readings and may be either of positive or negative polarity, depending upon which load cell reads the larger load.

The value of signal 87 may be converted to the strip unit tension by the following equation:

$$T = \frac{a\,(v - vo)}{tw\,(\tan x + \tan y)} \qquad \text{(Equation 1)}$$

where a = pounds vertical force (sum) per volt (load cell + amplifier gain value)
v = voltage signal 87 (with strip present)
vo = voltage signal 87 (without strip present)
t = strip thickness, inches
w = strip width, inches
x = angle 131
y = angle 132
T = strip unit tension, pounds/sq.inch This calculation is performed repeatedly in a computer, as cited below, during operation.

The value of signal 115 may be converted to the camber or curvature of the strip by the following equation:

$$c = \frac{7776\,Sb(e - eo)}{Etw^3\,(\tan x + \tan y)} \qquad \text{(Equation 2)}$$

where

S = load cell spacing, center to center, inches
b = pounds vertical force (difference) per volt (load cell + amplifier gain value)
e = signal 115 voltage with strip
eo = signal 115 voltage without strip
E = Young's modulus of strip, lb./sq. in.
t = strip thickness, inches
w = strip width, inches
x = angle 131
y = angle 132
c = camber, chord distance in 6 feet, inches The above definition of camber as a chord distance is standard in the metal industry. If c = 0, the strip is straight. A typical commercial tolerance for c is ±0.5 inches in six feet.

The above equation for c will be true if (a) sufficient tension exists in the strip to elastically stretch it straight and (b) the strip is centered on the tensiometer. In practice, these conditions will be true for small values of c provided the strip guides are well centered and the equipmemt precisely levelled.

When the value of the camber becomes larger, the strip begins to move on the sensing roll 121 towards the side where the shorter (higher-tension) edge is. This causes the measured camber to slightly exceed the true camber. However, when the value of the camber becomes greater still, there is insufficient tension to elastically stretch it flat and then it will tend to lift upon one side and lose contact with one side of the measuring roll altogether, leaving only one edge of the strip riding on the sensing roll. In this case, the measured camber will be less than the actual camber and the edge of the strip not touching the roll will appear "wavy" to the eye. The automatic control procedure later described works in spite of these factors and, once the camber is small (which it will be with good operating practice), the actual camber will agree closely with the value calculated from voltage 115.

The above equation is repeatedly evaluated by a computer during operation, as described below.

CONTROL SYSTEM-ROLL DRIVE

Figure 5:
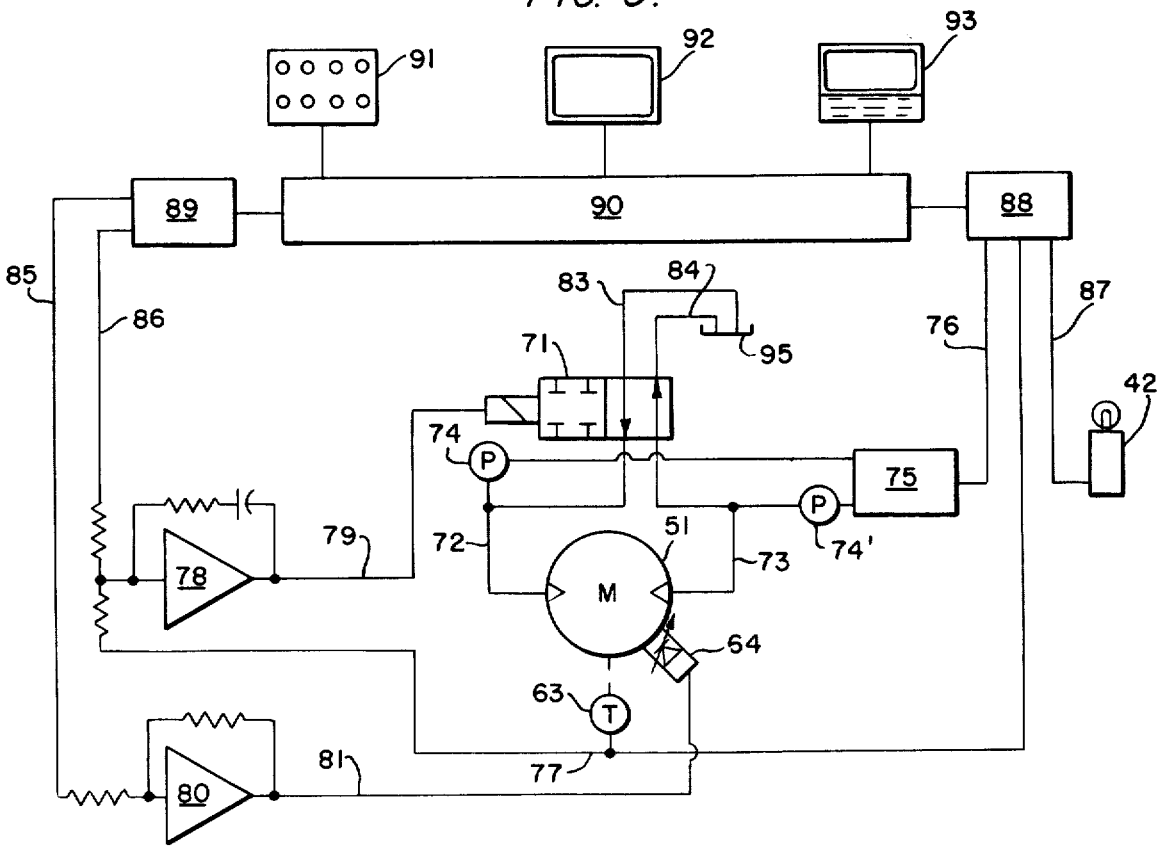
FIG. 5 is a circuit diagram of the electrical and hydraulic system for control of the hydraulic motor which drives one of the rolls of the roll stand illustrated in FIG. 1 and FIG. 2; an internal circuit is employed to control a separate hydraulic motor which drives the other roll.

FIG. 5 shows the electrical and hydraulic schematic for one roll drive motor (the other motor being controlled in the identical manner). A constant-pressure, variable-volume hydraulic oil supply 83 supplies oil to servo-valve 71. The discharge from the servo-valve 71 returns to the the hydraulic tank 95 via line 84. The servo-valve 71 is connected to the hydraulic motor 51 by the input line 72 and the output line 73. Although the servovalve 71 could operate the motor 51 in reverse, this is not needed and is not done. The lines 72 and 73 are equipped with pressure transducers 74, 74' of the strain gage type. These are wired to an amplifier assembly 75, which supplies excitation DC voltage to the transducers 74, 74' and which amplifies and subtracts the reading of transducer 74' from transducer 74 to produce an output signal 76 which is proporational to the difference in pressure from line 72 minus line 73, which is approximately proportional to the torque of motor 51. Thus signal 76 is called the torque signal.

As shown in FIG. 2, the motor 51 is coupled to a tachometer 63. Referring again to FIG. 5, the tachometer 63 produces an output signal 77 which is routed to the servo amplifier 78, i.e. the motor speed control servo amplifier. The output current 79 of servo amplifier 78 acts on the servo-valve 71 torque motor to vary the oil flowrate through line 72 to the motor 51 and hence to very the speed of the motor 51. The operation of the amplifier 78 is further described below.

The motor displacement proportional solenoid 64 is operated by current in line 81 from a linear amplifier 80, called the displacement amplifier.

Items 51, 63, 64 and 71 through 81 are duplicated for the fixed side and the movable side, whereas the other items in FIG. 3 are common to both sides.

The tensiometer 42 produces a signal 87 proportional to the tension in the strip. The tension signal 87, the tachometer signal 77 and the torque signal 76 are wired to a multichannel analog-to-digital converter 88, which converts these signals and communicates their values to the main control digital computer 90 every 1/10 second.

The computer 90 is also connected to an operator switch panel 91, a video display 92, and a video operator terminal 93, whose functions are explained below. The computer 90 is also connected to a multi-channel digital-to-analog converter 89, which produces under computer control the displacement command signal 85 and the speed command signal 86. The displacement current 81 is merely an amplified signal 85, whereas the speed servo amplifier 78 implements a closed-loop servo system. The command 86 is opposite in polarity to the tachometer signal 77. The amplifier 78 will integrate the speed error (difference between the desired and actual speeds) until the error is zero. The amplifier 78 must be well "tuned" in accordance with known art to produce good speed control and transient response and to prevent stalling on sudden load increases.

The operator station 91 is used by the equipment operator to instruct the computer 90 (by means of the switches provided) to start, stop, accelerate and decelerate the mill and also to select Automatic Tension Control when desired (described below). Switches are also provided for manual tension control (see below). The video display 92 displays to the operator the values calculated from both the inputs from converter 88 and the outputs to converter 89. Such calculations convert the voltage signals to engineering units familiar to the operator and also employ parameters such as strip width and thickness, which are entered by the operator via the terminal 93. Among the specific items of information thus displayed are:

(a) Mill speed, in feet per minute, derived from signal 77 (tachometer);

(b) Mill torque, in inch-pounds, derived from signal 76 (torque), signal 85 (displacement), and a zero torque reading previously measured without strip;

(c) Strip tension, in pounds/square inch, derived from signal 87, strip thickness, and strip width (the latter two entered by the operator) as per Equation (1);

(d) Motor displacement, derived from signal 85;

(e) Motor speed ratio versus the line master speed value, derived from signal 86;

(f) Whether or not the automatic tension control is turned on, derived from a switch position on station 91.

The automatic tension control operates through mill speed only when two or more mill stands are rolling in tandem (otherwise, tension is automatically controlled by bridles and/or spoolers). By varying the relative speeds of the two stands, the strip tension between them may be increased or decreased. Under manual operation, the value of the speed command 86 is changed based upon the operator switches on station 91. In the automatic tension control mode (ATC), a computer software loop is active whenever the stand is in use. The loop is executed at a time interval which varies inversely with the mill speed, as indicated by tachometer signal 77. The operator enters on the keyboard 93 the desired lower and upper limits for strip tension in pounds per square inch (of cross-section). During each execution of the loop, and provided that the mill is turning, another mill in line is also rolling, and the automatic tension control is still turned on, the speed signal 86 will be increased by (for example) 1% of its present value if the tension in the strip is above the desired upper limit or decreased by (for example) 1% of its present value if the tension is below the lower limit.

A second automatic control function called Automatic Displacement Control (ADC) is also available, and may be selected by using the keyboard 93. When selected, another software loop, which is executed every 10 seconds, for example, examines the mill speed tachometer signal 77 and the torque signal 76. Whenever the mill is running slowly, the displacement command 85 is maintained at 100%, because high torque is needed for startup and low speed operation and because the hydraulic oil flow requirement is low even at 100% displacement at low speeds. Once the speed exceeds a certain selected value, however, the torque signal 76 is then examined. If it indicates a pressure difference (line 72 minus line 73) less than (for example) 90% of the maximum safe operating value (too high a pressure difference will lead to motor stalling on minor load fluctuations), then the motor displacement command is automatically reduced by an amount to bring the pressure difference (torque signal) towards, but not to exceed, about 90% of the maximum safe value. Likewise, if the torque signal becomes too large, the displacement is automatically increased. Since the rolling conditions and product thickness are established at low speeds prior to acceleration, there will not be sudden changes in torque needs at the higher speeds, and so a 10-second loop time is sufficiently fast.

The purpose of this ADC is to increase the horsepower efficiency of the mill stand by minimizing the flowrate used of the constant-pressure oil supply 83, and to avoid exceeding the volumetric capacity of this supply at high line speeds.

GAUGE, WEDGE, AND CAMBER CONTROL SYSTEM

Figure 6:
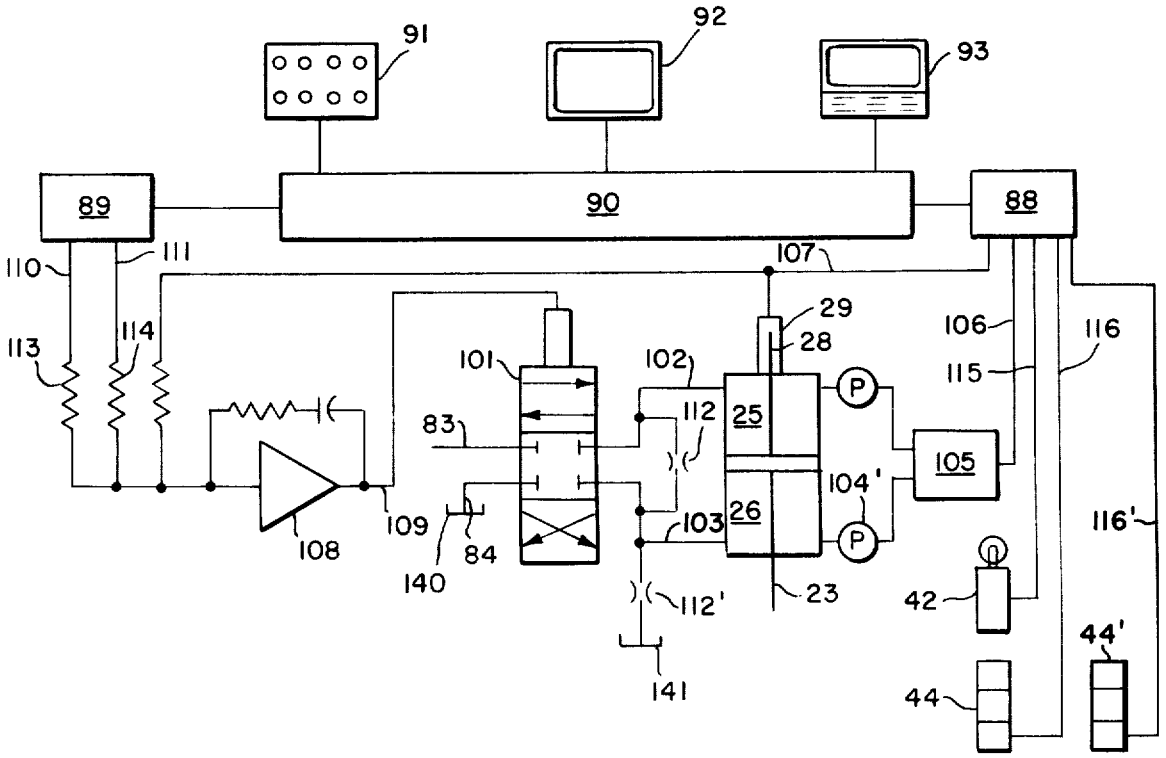
FIG. 6 is a circuit diagram of the electrical and hydraulic system for control of the hydraulic assemblies for gauge and camber control which are associated with the roll mill and one of which is shown in FIG. 1.

FIG. 6 is a schematic of the hydraulic and electrical control system for the dual hydraulic assemblies 10. Again, only a single hydraulic assembly 10 is shown. The second is identical to the first. Hydraulic oil is supplied via line 83 at a constant pressure and variable volume to a small servo-valve 101, which is connected to the oil tank by a return line 84. The downstream side of the valve is connected to the cap end chamber 25 of the cylinder by line 102 and to the rod end chamber 26 by line 103. The chambers 25 and 26 are separated by piston 21 whose position is measured by an LVDT position transducer consisting of movable core element 28 and fixed element 29, as previously described. The pressures in chambers 25 and 26 are measured by strain-gage type pressure transducers 104 and 104' respectively, which are identical to the types used as items 74 and 74' above. They are wired to an amplifier assembly 105 which amplifies and subtracts the signal 104' from 104 after appropriate weighting of the signals to account for the area of rod 23 being present on the rod end only. The output signal 106 is thus proportional to the force exerted downwards by the rod 23 (if friction of the piston and rod are neglected) and is referred to as the force signal. The LVDT signal 107 is wired to both the multichannel analog-to-digital converter 88 (the same as shown in FIG. 3) and to the servo amplifier 108. Also wired to the converter 88 are the force signal 106, the tensiometer camber signal 115 (which indicated strip straightness, as noted previously) and the thickness error signal 116 from the thickness gauge 44. If wedge measurement and/or control is desired, a second thickness gage 44' is also used, with its signal 116'.

The position servo amplifier 108 receives, in addition to the LVDT signal 107, a coarse position command signal 110 and a vernier position command signal 111 from the multi-channel digital-to-analog converter 89. The input resistor 114 on signal 111 is (for example) 125 times larger than the resistor 113 on signal 110, thus giving the required combination of large motion range (e.g. 1.0 inches) plus very fine resolution (e.g. 0.000001 inches) by using both the coarse and vernier commands together. The output current 109 from the servo amplifier 108 will increase or decrease as required to cause the actual position of piston 21 to match the desired position very accurately.

A small orifice 112 allows a small flow of oil from chamber 25 to 26 (or vice versa) and another small orifice 112' allows a small flow of oil from chamber 26 to tank 141. These orifices provide cooling of the oil by requiring oil to be supplied continually and also improve the dynamic performance of the position control by causing the servo valve 101 to operate in its linear range while rolling strip rather than in its deadband, non-linear range. They also allow any air bubbles present to be flushed out of the hydraulic assemblies.

The valve 101 is mounted extremely close to the hydraulic cylinder 10 to minimize the compressed oil volume and hence improve dynamic gap control performance. The LVDT transducer, arranged in accordance with the present invention, exhibits no backlash or mechanical deflection. The area of piston 21 is relatively large and the inertia of the moving chock 35 plus the two hydraulic assemblies 10 is low. All of these factors permit the servo amplifier 108 to be tuned to very high gain (band-width) and thus produce excellent dynamic as well as steady-state accuracy, which permit the rolling of strip with excellent thickness tolerances, even with somewhat variable incoming thickness.

Items 23 through 29 and 101 through 114 in FIG. 6 are all duplicated for the movable and fixed hydraulic assemblies.

Items 90 through 93 are also used to control the roll gap in addition to controlling the drives as explained above. Operator station 91 has switches which the operator uses to instruct the computer 90 to open or close the rolls (typically ½ inch opening is used) or to vary roll position. A coarse position switch changes the roll position by 0.001 inch per "click", while the fine position switch changes the roll position by 0.0001 inch per "click". These switches cause the commands 110 and 111 to be changed by exactly the same amount for both hydraulic assemblies.

Another set of operator switches is used to vary the tilt or relative piston position of the "movable" hydraulic assembly relative to that of the "fixed" hydraulic assembly (the assembly on the same side as the motor driving the fixed or bottom roll). A coarse tilt "click" is 0.0005 inches and a vernier tilt "click" is 0.00005 inches. This amount is added to one piston and subtracted from the other as the operator selects.

The roll gap adjustment controls govern strip thickness, while the roll tilt controls govern strip camber or straightness, and strip wedge as further explained below.

The video display 92 displays the following rollgap related information (in addition to the previously-mentioned speed-related information):

(a) Roll gap setpoint, derived from commands 110 and 111 a previously measured zero value.

(b) Roll tilt setpoint, derived from commands 110 and 111 for both mills and a previously measured zero value.

(c) Strip thickness, derived from signal 116 and the operator-entered target thickness.

(d) Strip camber, derived from signal 115 and the operator-entered thickness and width per Equation 2.

(e) Rolling force, derived from signal 106 (sum of both cylinders).

(f) Whether or not the Automatic Gage Control (AGC), Automatic Chamber Control (ACC), Automatic Force Control (AFC), or Automatic Wedge Control (AWC) are selected (see below).

The operator terminal 93 is used by the operator to enter target thickness, nominal width, and target force for the automatic control modes.

Manual control of thickness, camber, or force is achieved by the operator viewing the video display 92 and adjusting the roll gap and tilt via the switches at station 91. Automatic controls are implemented as follows:

(1) The automatic control software loop is executed repeatedly when a mill stand is active with a time interval which is inversely proportional to mill speed, as described in connection will speed control. This interval allows sufficient time for the strip to reach the thickness gage(s) and a new thickness reading to be taken. By this time, a new camber and force reading are also available via the transducers and converter.

(2) Automatic Gauge (thickness) Control (AGC) changes the mill gap by a selected percentage of the thickness error. This percentage is suitably about 20–40% to avoid making changes too quickly (which could cause tension or camber to fluctuate too rapidly). Moreover, the maximum position change at one time is limited to 0.0005 inches. Tests are included in the software to ensure that the thickness gage is not "off-line". Due to the inherent constant-gap design of the mill itself, thickness errors are caused mainly by slow thermal expansion of the equipment or by major changes in the incoming strip which alter the rolling force and hence mill stand stretch significantly. Thus a fractional correction per cycle still achieves excellent strip quality in practice.

(3) Automatic Force Control (AFC) is used when a thickness gage is not available for a given mill stand. The force signal 106 is compared with the setpoint and the position is adjusted by an amount proportional to the error which is roughly equivalent to removing 10–20% of the error for a typical product (per correction).

(4) Automatic Camber Control (ACC) utilizes the camber signal 115 from the tensiometer 42, converted to Camber (inches/6 ft.) by Equation 2. The correction applied per loop is given by:

$$p = \frac{dctf}{1296} \quad \text{(Equation 3)}$$

where d = distance between cylinder (10) centers, inches c = camber, inches in 6 ft. (chord distance)

t = strip thickness f = fraction to be corrected per cycle (usually 10–20%)

p = change in fixed side and movable side positions (one + and one −), inches

This equation is evaluated by the computer every time the loop executes. Whenever the camber exceeds a certain value, for example ½ inch in 6 feet, the magnitude of the correction applied is increased by a factor of 2½ to quickly move the strip back towards zero camber before it moves too far from centerline and perhaps breaks.

The value of p calculated is used to adjust the fixed and movable hydraulic assembly position commands 110 and 111 as appropriate.

Whenever a change is made (either manual or automatic) to either vernier position command, the software checks whether the vernier value has exceeded some limit, such as +2 volts, for example. If it has, it will correct the coarse signal 110 and the vernier signal 111 so that the weighted sum is still the same. This procedure prevents the occurence of vernier "saturation", since the circuits are limited, for example, to +2 volts.

(5) Automatic Wedge Control (AWC) is used on the first stand, when tandem rolling, as an alternative to automatic camber control. Dual thickness gages are used with the average being used for gauge control and the difference for wedge control, with about 20–30% correction per cycle, the mill being tilted to remove the wedge and bring both thickness readings equal.

TANDEM MILL OPERATION

For tandem operation, two or more mills are preset to selected speed ratios relative to one another. Rolling is begun one stand at a time beginning at the upstream end by closing the roll gap. The automatic tension control (ATC) is used to adjust mill speeds in order to keep the interstand tension within desired limits. Each individual mill is operated under automatic camber control (ACC) or automatic wedge control (AWC) and either automatic gauge control (AGC) or automatic force control (AFC). The automatic displacement control (ADC) may also be used at the higher speeds.

The mill control system of the present invention works very well in tandem, with good overall stability even when fluctuations in incoming strip thickness are encountered.

The operator station 91 will cause the computer to accelerate or decelerate all the mills smoothly in unison, while continuing to hold product dimensions very nearly constant.

The invention may be embodied in other specific forms without departing from the spirit or essential characteristics thereof. The present embodiments are therefore to be considered in all respects as illustrative and not restrictive, the scope the invention being indicated by the appended claims rather than by the foregoing description, and all changes which come within the meaning and range of equivalency of the claims are therefore intended to be embraced therein.

I claim:

1. A rolling mill system for rolling metal into strip form comprising:

(a) a roll mill stand comprising:

(i) a frame;

(ii) a pair of metal working rolls mounted in said frame to define a gap therebetween suitable for metal rolling, one of said metal working rolls being movable with respect to said frame;

(iii) drive means for rotating said metal working rolls; and (iv) at least two gap adjusting devices, mounted in said frame on opposite sides of the centerline of the metal strip, for applying forces independently to opposite ends of said movable metal working roll; and (b) means for measuring the camber of the rolled metal strip, said camber measuring means being external to said roll mill stand and comprising a pair of load cells, each cell supporting one end of a cylindrical roller over which said strip travels; and (c) control means for generating a control signal representative of the measured camber and for operating at least one of said gap adjusting devices to change the tilt of said movable working roll, with respect to the other roll, responsive to said control signal, said means for generating a control signal comprising:

(i) means for generating a voltage signal representative of said difference in tension across the width of the strip and camber;

(ii) means for converting said voltage signal to a value for actual camber in accordance with the following equation:

$$c = \frac{7776\, Sb(e - eo)}{Etw^3 (\tan x + \tan y)}$$

where

S is the load cell spacing, center to center;

b is the vertical force (difference) per volt;

e is the voltage signal with strip in place on cylindrical roller;

$e_o$ is the voltage signal without strip in place on the cylindrical roller;

E is the Young's modulus of strip;

t is the strip thickness;

w is the strip width;

x is the angle between the metal strip and the horizontal at the approach to said cylindrical roller;

c is the camber chord distances, inches in 6 feet;

y is the angle between the metal strip and the horizontal leaving said cylindrical roller; and c is the actual camber over a specified chord distance; and (iii) means for converting the calculated actual camber value to said control signal.

2. The rolling mill system of claim 1 wherein said rolls are each mounted in radial bearing segments contained in a chock block.

3. The rolling mill of claim 2 wherein said rolls are vertically arranged.

4. The rolling mill system of claim 1 wherein said gap adjusting devices each include hydraulic cylinders.

5. A rolling mill assembly for rolling metal into strip form comprising:

(a) a frame;

(b) a pair of metal working rolls mounted in said frame, one of said metal working rolls being vertically movable with respect to said frame;

(c) drive means for rotating said metal working rolls; and (d) gap adjusting means for moving said metal working rolls relative to one another to control the distance therebetween and to thereby form a gap suitable for rolling metal, said gap adjusting means comprising:

(i) at least first and second hydraulic cylinder and piston assemblies mounted on said frame on opposite sides of the centerline of the metal strip;

(ii) fluid supply means for supplying hydraulic fluid to the cap end side of the piston and to the piston rod side of the piston in each of said hydraulic assemblies;

(iii) a piston rod affixed to a first face of each of said pistons for transmitting force from said hydraulic assemblies onto opposite ends of said vertically movable metal working roll;

(iv) a position-detecting rod affixed to the cap end of each piston and axially aligned with the cylinder and piston rod; and (v) a first transducer component mounted in a fixed position relative to said frame and a second transducer component carried by the free end of said position-detecting rod, said second transducer element being displaced relative to said first transducer component through a distance equal to any change in the distance between said working rolls, (e) means for producing a camber signal proportional to the difference in tension across the width of the rolled strip;

(f) means for converting said camber signal to a value for the camber of the strip and for converting said camber value to a hydraulic control signal; and (g) means for positioning at least one of said pistons responsive to said hydraulic control signal.

6. The rolling mill assembly of claim 5 wherein said first and second hydraulic assemblies are mounted adjacent opposite ends of said metal working rolls.

7. The rolling mill of claim 6 wherein the rolls are vertically arranged and wherein each roll is contained in radial bearing segments mounted in a chock block.

8. The rolling mill of claim 7 wherein said hydraulic cylinders are cavities within a single block of metal mounted on the top of said frame.

9. The rolling mill assembly of claim 5 wherein said second transducer element is a magnetic core and said first transducer element is a transformer coil having an axial passageway therethrough for receipt of said magnetic core.

10. The rolling mill assembly of claim 7 wherein the opposite ends of said piston rods are affixed to the uppermost chock block.

11. The rolling mill assembly of claim 5 wherein the rolls are mounted in individual chock blocks and wherein said frame has the configuration of a box and comprises:

a base;

a pair of side plates fixed to said base and having ports for entry and exit of the metal strip, said side plates forming a guide for vertical movement of the upper chock block;

an end plate fixed to said base plate, said end plate and said side plates being joined to form three sides of the frame box;

a door mounted for pivotal movement about a vertical axis between a first position closing the frame box and a second position allowing free access to said rolls and chocks; and means for mounting said drive means on said door.

12. The rolling mill system of claim 1 further comprising means for converting the value for actual camber (c), in a camber control loop, to a correction value p in accordance with the following equation:

$$p = \frac{dctf}{1296}$$

wherein:

d is the distance between said gap adjusting devices;

c is the camber over a specified chord distance;

t is the strip thickness;

f is the fraction of actual camber to be corrected per cycle of the camber control loop;

p is the distance through which one gap adjusting device must be moved relative to the other per correction cycle;

and wherein said control signal is a function of p.

13. The roll mill system of claim 1 wherein said drive means for at least one of said rolls is a hydraulic motor and wherein said system further comprises:

a tachometer for generating a speed proportional to the speed of said hydraulic motor;

means for generating a signal proportional to motor torque;

means for comparing said speed signal with a first preset value and, if said speed signal exceeds said first preset value, comparing said torque signal to a second preset value and, if said torque signal exceeds said second preset value, generating a command signal to increase motor displacement; and means for varying the displacement of said hydraulic motor responsive to said command signal.

14. A roll mill system in accordance with claim 1 comprising two of said roll mill stands in tandem and a tensiometer positioned between said two roll mill stands and including a cylindrical roller in contact with the metal strip, said tensiometer producing a tension voltage signal proportional to the vertical force exerted on said tensiometer.

15. The vertical mill system of claim 14 further comprising:

means for converting, in a tension control loop, said tension voltage signal to a value for strip unit tension (T) in accordance with the following equation:

$$T = \frac{a\,(v - v_0)}{tw\,(\tan x + \tan y)}$$

wherein:

a is the vertical force (sum);

v is the voltage signal with strip present;

$v_o$ is the voltage signal without strip present;

t is the strip thickness;

w is the strip width;

x is the angle between the strip and the horizontal approaching said cylindrical roller; and y is the angle between the strip and the horizontal leaving said cylindrical roller;

means for generating a speed control signal proportional to the calculated value for strip unit tension; and means for varying the speed of the drive means of one roll mill stand, relative to the other and responsive to said speed control signal.

16. The system of claim 15 wherein said tension control loop is executed at a time interval which varies inversely with the magnitude of said speed signal.

17. The rolling mill assembly of claim 5 further comprising:

means for measuring the hydraulic pressures at the cap end side of the piston and at the piston rod side of the piston;

means for subtracting the measured hydraulic pressure at the cap end side from that at the piston rod side and generating a force signal proportional to the difference;

means for comparing said force signal with a preset value to determine an error value and generating a command signal proportional to said error value; and means for repositioning the piston responsive to said command signal.

18. A process for rolling metal into strip form comprising:

(a) providing a roll mill stand comprising:

(i) a frame;

(ii) a pair of metal working rolls mounted in said frame to define a gap therebetween suitable for metal rolling, one of said metal working rolls being movable with respect to said frame;

(iii) drive means for rotating said metal working rolls; and (iv) at least two gap adjusting devices, mounted in said frame on opposite sides of the centerline of the metal strip, for applying forces independently to opposite ends of said movable metal working roll; and (b) measuring the camber of the rolled metal strip at a location external to said roll mill stand using a pair of load cells, each cell supporting one end of a cylindrical roller over which said strip travels when external to said roll mill frame; and (c) control means for generating a control signal representative of the measured camber and for operating at least one of said gap adjusting devices to change the tilt of said movable working roll, with respect to the other roll, responsive to said control signal, said means for generating a control signal comprising:

(i) generating a voltage signal representative of said difference in tension across the width of the strip and camber, as a function of the difference in loading between the two cells;

(ii) converting said voltage signal to a value for actual camber in accordance with the following equation:

$$c = \frac{7776\, Sb(e - eo)}{Etw^3 (\tan x + \tan y)}$$

where

S is the load cell spacing, center to center;

b is the vertical force (difference) per volt;

e is the voltage signal with strip in place on cylindrical roller;

$e_o$ is the voltage signal without strip in place on the cylindrical roller;

E is the Young's modulus of strip;

t is the strip thickness;

w is the strip width;

x is the angle between the metal strip and the horizontal at the approach to said cylindrical roller;

c is the camber chord distances, inches in 6 feet;

y is the angle between the metal strip and the horizontal leaving said cylindrical roller; and c is the actual camber over a specified chord distance; and (iii) converting the calculated actual camber value to said control signal.

19. The rolling process of claim 18 wherein said drive means for at least one of said rolls is a hydraulic motor and wherein said process further comprises:

providing a tachometer for generating a speed proportional to the speed of said hydraulic motor;

generating a signal proportional to motor torque;

comparing said speed signal with a first preset value and, if said speed signal exceeds said first preset value, comparing said torque signal to a second preset value and, if said torque signal exceeds said second preset value, generating a command signal to increase motor displacement; and varying the displacement of said hydraulic motor responsive to said command signal.

20. The rolling mill process of claim 18 wherein the value for actual camber (c) is converted, in a camber control loop, to aid control signal as a function of p calculated in accordance with the following equation:

$$p = \frac{dctf}{1296}$$

wherein:

d is the distance between said gap adjusting devices;

c is the camber over a specified chord distance;

t is the strip thickness;

f is the fraction of actual camber to be corrected per cycle of the camber control loop;

p is the distance through which one gap adjusting device must be moved relative to the other per correction cycle.

* * * * *